United States Patent [19]

Dubrulle et al.

[11] Patent Number: 4,619,113

[45] Date of Patent: Oct. 28, 1986

[54] PROCESS AND INSTALLATION FOR COOLING A POWDER BY MEANS OF A REFRIGERATING FLUID

[75] Inventors: Gérard Dubrulle, Lambersart; Alain Roullet, Villejuif, both of France

[73] Assignee: L'Air Liquide, Societe Anonyme pour l'Etude et l'Exploitation des Procedes Georges Claude, Paris, France

[21] Appl. No.: 747,013

[22] Filed: Jun. 20, 1985

[30] Foreign Application Priority Data

Jun. 22, 1984 [FR] France ..... 84 09810

[51] Int. Cl.[4] ..... F25D 17/02

[52] U.S. Cl. ..... 62/64; 62/70; 62/373; 62/514 R

[58] Field of Search ..... 62/69, 70, 64, 373, 62/514 R

[56] References Cited

U.S. PATENT DOCUMENTS

| | | | |
|---|---|---|---|
| 2,648,206 | 8/1953 | Carr | 62/64 |
| 2,919,862 | 1/1960 | Beike et al. | 62/64 |
| 3,036,440 | 5/1962 | Feinman | 62/64 |
| 3,150,496 | 9/1964 | Hightower | 62/64 |
| 3,410,065 | 11/1968 | Martin | 62/64 |
| 3,583,172 | 6/1971 | Koudelka et al. | 62/70 |
| 3,672,182 | 6/1972 | Stowasser et al. | 62/70 |
| 4,222,527 | 9/1980 | Davis | 62/64 |
| 4,245,478 | 1/1981 | Covy | 62/70 |
| 4,250,714 | 2/1981 | Covy | 62/64 |
| 4,348,867 | 9/1982 | Musschoot | 62/64 |
| 4,479,362 | 10/1984 | McWhorter et al. | 62/70 |

FOREIGN PATENT DOCUMENTS

| | | |
|---|---|---|
| 2456556 | 7/1978 | France . |
| 2532821 | 3/1984 | France . |

*Primary Examiner*—Ronald C. Capossela

*Attorney, Agent, or Firm*—Lee C. Robinson, Jr.

[57] ABSTRACT

A device for injecting a liquefied refrigerating fluid directly into a mass of detergent powder within a hopper the device being connected to a tank storing this fluid under pressure.

21 Claims, 3 Drawing Figures

PROCESS AND INSTALLATION FOR COOLING A POWDER BY MEANS OF A REFRIGERATING FLUID

The present invention relates to a process and an installation for cooling a powder, and in particular a detergent powder, by means of a refrigerating fluid.

In various industries manufacturing various powders, it is necessary to cool these powders for various reasons, owing both to the particular constitution of the powders and to requirements of the packing operations. Such is for example the case of washing powders termed "economic" powders which act at low temperature (30° to 60° C.) instead of boiling point and to which are added washing or surface-active agents or other specific additives which cannot support high packing temperatures. Usually, a washing powder is produced in a continuous manner in amounts usually ranging from 10 to 50 metric tons per hour in a single installation. The raw materials (liquids and solids) are conveyed, after having been mixed and then dried (for example by hot air), by means of conveyor belts, in the form of a powder having a mean particle size of 500 microns. The powder then arrives at the base of a vertical or slightly inclined cylinder while it is still at a temperature of 70° to 90° C. The powder is then aspirated upwardly in this cylinder with colder surrounding air until it arrives at a point situated 10 to 40 meters higher, at which point it is separated from the air by the force of gravity. The powder then falls into one or more hoppers from which it is taken for receiving the specific additives before being conveyed to the packing shop.

The desired temperature in the hopper receiving the washing powder is about 25° to 40° C. Now, as soon as the temperature of the air aspirated from the base of the elevating cylinder by the current of air is relatively high (in particular in the summertime), the cooling of the powder achieved by thermal exchange with this aspirating air is found to be insufficient. This has led to the use of additional cooling processes for the purpose of obtaining the desired temperature in the receiving hopper.

According to a known process in which the cooling is ensured by a mechanical unit, there is employed a refrigerating unit which cools either the powder along (by means of for example a solid/liquid exchanger) or the air alone or both the air and the powder. This process has the drawback of a low efficiency, of being very expensive and hardly reliable and of lacking flexibility.

Another process which has been tried comprises spraying liquid nitrogen at the base of the elevating cylinder by means of an air current. For this purpose, liquid nitrogen under very low pressure is expanded and vaporized at the base of the elevating cylinder and at the entrance of the aspirated air. The liquid nitrogen spraying device may be formed by a simple ring provided with upwardly oriented orifices or by a system of liquid nitrogen supply tubes oriented upwardly. The exchange of negative calories with the air and the powder aspirated upwardly is relatively homogeneous owing to the Reynolds number and the height of the elevating cylinder employing an air current.

The latter process has the drawback however of cooling both the air and the powder. Moreover, any leakage of nitrogen, owing to a stoppage or a defective operation of the fan, or any clogging of the liquid nitrogen injecting device by the dropping of powder agglomerate, constitutes a risk for the users. It is therefore absolutely necessary to provide grinding systems.

U.S. Pat. No. 4,222,527 describes a cryo-grinding process in which a particular product to be crushed is first of all cooled in a cylindrical hopper by means of liquid nitrogen. The latter is conveyed through a tube provided with orifices oriented upwardly and placed at the base of the hopper. The product thus pre-cooled is then ground without injection of liquid nitrogen, at low temperature.

Such a system has drawbacks which render it unsuitable for use in the cooling of detergent powders. As it is placed in a hopper containing a great thickness of powder, the tube provided with an opening is rapidly blocked. Further, its shape does not permit the obtainment of a homogeneous cooling of the powder.

An object of the present invention is to overcome these drawbacks by providing a process and an installation which are remarkably simple in design, very easy to employ and permit the obtainment of a selective cooling of the powder along with a variable supply of refrigerating agents under the best conditions of safety.

For this purpose, this process for cooling a powder, in particular a detergent powder, by means of a refrigerating fluid is characterized in that the refrigerating fluid, in the liquified state, is injected within the very powder stored in a hopper receiving the latter.

Another object of the invention is to provide an installation for carrying out the aforementioned process, in which the powder drops into a receiving hopper before its distribution toward a station located downstream of the hopper, said installation comprising, in the powder receiving hopper, a device for injecting a liquified refrigerating fluid, said device being connected to a tank of this fluid under pressure.

The installation also comprises a regulating unit comprising a temperature sensor for taking the temperature of the powder at the outlet of the hopper, and as a means of controlling the flow of the refrigerating fluid toward the injection device as a function of the temperature of the powder detected by the sensor.

The process and installation according to the invention permits a cooling in the hopper of the powder without modifying its physico-chemical characteristics and its particle size, whatever be the flow of the powder at the outlet of the hopper.

The refrigerating fluid employed in the process and installation according to the invention is chosen in such manner as to be inert as concerns the powder, and it may be formed preferably by liquid nitrogen.

As compared to known cooling processes, the process according to the invention affords the advantage of enabling a very great economy of liquid nitrogen to be achieved. Further, this process has very great flexibility in carrying it out owing to the fact that the rate of flow of liquid nitrogen can be easily adapted to the conditions of the production and in particular to the rate of flow of the cooled powder at the outlet of the hopper. The process according to the invention also results in an additional saving as concerns the power required for heating the air discharged at the top of the elevating cylinder employing an air current, for the purpose of using this air for the drying, bearing in mind that the air used for entraining the powder in the elevating cylinder is not cooled. The process does not require the installation of an oxygen detecting means since the cooling is not achieved in the regions of the workshops. The injection of the cryogenic fluid actually within the powder stored in the receiving hopper results in an effect of rendering it inert with respect to this powder, while in the conventional process the gaseous nitrogen is entrained outside with the air.

There will now be described by way of a non-limiting example one embodiment of the invention with reference to the accompanying drawing, in which.

Figure 1:
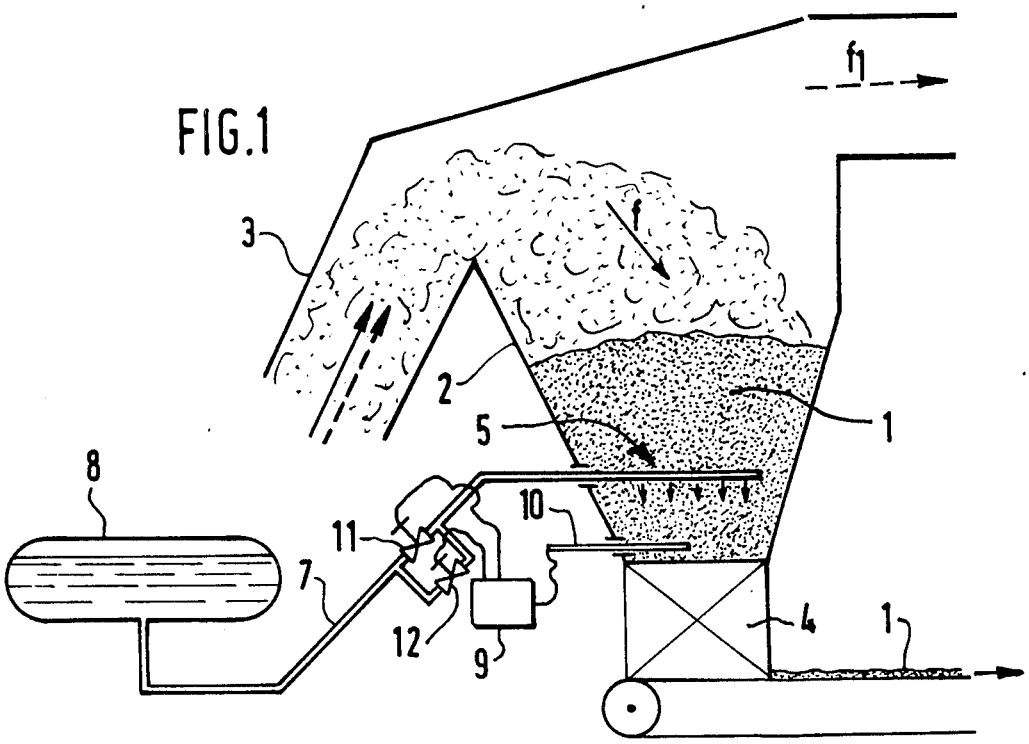
FIG. 1 is a diagrammatic vertical sectional view of a cooling installation for a powder contained in a receiving hopper.

The cooling installation shown in FIG. 1 is adapted to cool a mass of powder 1 contained in a receiving hopper 2. This receiving hopper 2 has a frustoconical or pyramidal shape and is located below the upper end of a vertical or slightly inclined elevating cylinder 3 in which the powder is aspirated with surrounding air. At the upper end of the elevating cylinder 3 the powder is separated from the air current and falls into the hopper 2, as indicated by the arrow f in full line, while the air continues its movement toward the exterior as indicated by the arrow f1 shown in dashed lines. Thus, in a first stage of the process, (unnecessary stage, as the process according to the invention may start solely in the following stage) the powder is first of all precooled by the aspirated air in a system termed an "air-lift" system. At the base of the receiving hopper 2 is an extracting and metering device 4, for example of the rotary valve type, which ensures the distribution on a conveyor belt of a suitable flow of powder 1 cooled to a given temperature.

Figure 2:
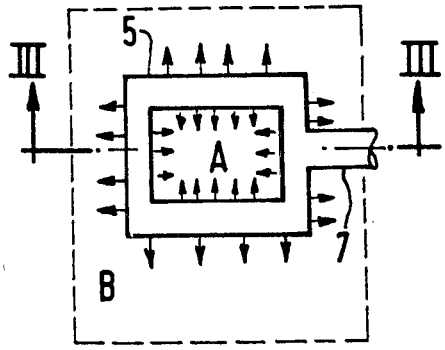
FIG. 2 is a plan view of a device for injecting liquid nitrogen into the powder.
Figure 3:
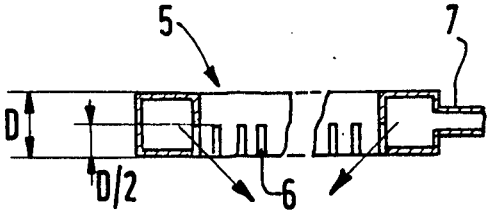
FIG. 3 is a partial vertical sectional view taken on line III—III of FIG. 2, of the liquid nitrogen injecting device.

According to the invention, the powder 1 is cooled while it is within the receiving hopper 2, by means of a liquefied cryogenic fluid injecting device, this fluid being for example liquid nitrogen. This injecting device 5 is advantageously formed by a tubular frame having a polygonal or circular shape in plan extending horizontally across the hopper 2 and connected, externally, to a source of liquid nitrogen. The shape of the tubular frame is adapted to the section of the hopper and is at a sufficient distance from the edges of the hopper to ensure that the liquid nitrogen does not come into contact with the walls of the hopper before vaporization. In plan view (FIG. 2), the area B between the edges of the hopper and the tubular frame is substantially equal to the area A within the frame. This tubular frame 5 is provided with orifices, in particular slots 6 (FIG. 3), which are evenly spaced apart on its wall. The area and the number of these slots 6 depend on the desired flow of liquid nitrogen. The slots 6 extend vertically for a distance about equal to one half the vertical dimension D of the frame, and their symmetry is such that they inject the same amount of nitrogen toward the surfaces A and B.

The liquid nitrogen is injected under pressure so as to be capable of penetrating the powder. The slots 6 are preferably formed in the lower part of the inner wall of the tubular frame 5 so that each of these slots 6 forms an elementary jet of liquid nitrogen oriented toward the base and toward the vertical axis of the hopper, i.e. toward and zone where the pressure of the powder is highest.

Preferably, the tubular frame 5 injecting the liquid nitrogen must be located at a height from the base of the receiving hopper 2 which is between one half and one third of the height of the mass of powder 1.

The liquid nitrogen injecting device 5 injecting the nitrogen within the mass of powder 1 provides the desired rates of flow of liquid nitrogen while avoiding the "throwing up" or the rising of the liquid nitrogen or cold gaseous nitrogen in the cracks created in the mass of powder 1. The injecting device 5 must also be designed to permit a good homogeneity of the distribution of the negative calories supplied, while avoiding a clogging thereof, i.e. it must not be closed as a result of frosting due to 10% to 15% humidity of the powder 1 or by the powder itself.

The injecting device 5 is connected through an insulated cryogenic line 7 to a tank (or evaporator) of liquid nitrogen 8 under pressure. The location of the tank 8 is determined by the height at which the liquid nitrogen must be injected into the powder 1.

The cooling installation according to the invention further comprises a unit for regulating the flow of liquid nitrogen injected into the powder 1. This unit comprises a regulator 9 which is connected to a temperature sensor 10 located in the lower part of the hopper 2 so as to continuously measure the temperature of the powder 1 at the outlet of this hopper. This regulator acts on one or more valves inserted in the cryogenic line 7. In the non-limiting embodiment shown in the drawing, the regulator 9 controls two valves 11 and 12 connected in parallel.

By using two valves 11, and 12 regulation is provided of the "full, low or no flow" type. The "full or low" flow regulation is accomplished by opening one of the two valves 11 and 12 or both valves at the same time and it provides a lower diphasic rate owing to a permanent flow of the gaseous phase in the cryogenic line 7. Further, uneven flows and overpressures in the powder 1 are limited, with the result that there is a very great reduction in the blowing of "fines" or overpressures exerted on the extracting and metering device 4. This blowing of fines is also reduced owing to the frustoconical or pyramidal shape of the hopper, because the velocity of the gas decreases as it rises, bearing in mind the increase in the area of the hopper toward the top of the latter.

It is clear from the foregoing description that the cooling is achieved by a direct injection of liquid nitrogen in a region where only the powder 1 is present, the temperature of this powder having been already lowered owing to its passage through the air-lift cylinder 3. This direct injection of liquid nitrogen through the injecting device 5 within the mass of powder 1 permits a regulation of the refrigerating power over a very wide range.

There will now be given by way of example the comparative results obtained by injection of a cryogenic fluid at the base of the airlift cylinder according to a conventional process and by injection of this fluid in the upper part in the receiving hopper 2 located 30 meters above the ground. For a fixed rate of flow of 30,000 kg/h of the powder, a powder temperature of about 80° C., a temperature of the air of about 28° C. and a desired temperature of the powder of 35° C., a specific heat of the powder of 0.33 kcal/kg and a specific heat of the air of 0.24 kcal/kg, there is consumed according to the conventional process which consists in injecting liquid nitrogen at the base of the air-lift cylinder, an hourly rate of flow of 4,111 l/h whereas, with the process according to the invention in which the liquid nitrogen is injected in the upper part in the hopper 2, the hourly rate of flow is only 1,739 ll/h. In other words, the process according to the invention permits a reduction of about 58% in the hourly consumption of liquid nitrogen required for producing at the outlet of the receiving hopper 1 a powder having the desired temperature of 35° C.

Although there has been described the application of the process and installation according to the invention to the cooling of a detergent powder before the latter is packed, it will be understood that they may also be employed in other industrial fields, for example for the packing of colouring powders, in other words whenever the temperature of the powder must be reduced to a desired value.

We claim:

1. A process for cooling a mass of powder contained in a fixed receiving hopper by means of a refrigerating fluid, comprising injecting the refrigerating fluid in the liquefied state through an injection device having a plurality of orifices within the mass of powder contained in the hopper and substantially below the surface of the mass of powder so that the refrigerating fluid directly contacts the mass of powder while the refrigerating fluid is still in the liquefied state.

2. A process according to claim 1, comprising injecting the liquefied refrigerating fluid in the form of elementary jets downwardly oriented toward a vertical axis of the receiving hopper.

3. A process according to claim 1, comprising injecting the liquefied refrigerating fluid under pressure within the mass of powder.

4. A process according to claim 1, comprising employing, as a liquefied refrigerating fluid, a fluid which is inert with respect to the powder.

5. A process according to claim 4, wherein the fluid is liquid nitrogen.

6. A process according to claim 1, wherein the powder has a mean particle size in the range of 500 microns.

7. A process according to claim 1, wherein said injection is accomplished in a fixed receiving hopper of frustoconical shape.

8. An installation according to claim 1, wherein said injection is accomplished in a fixed receiving hopper having an inverted pyramidal shape.

9. An installation for cooling a mass of powder by means of a refrigerating fluid, comprising a fixed receiving hopper containing the mass of powder, a device for injecting a liquefied refrigerating fluid within the mass of powder to directly contact the powder while the refrigerating fluid is still in the liquefied state, the device having a plurality of orifices and being located in the hopper substantially below the surface of the mass of powder, and means for storing said fluid connected to the injecting device.

10. An installation according to claim 9, further comprising a regulating unit including a temperature sensor for taking the temperature of the powder at an outlet of the hopper, and means for controlling the flow of the refrigerating fluid to the injecting device as a function of the temperature of the powder measured by the sensor.

11. An installation according to claim 10, wherein the means for controlling the flow of the refrigerating fluid comprise two valves connected in parallel, the regulating unit controlling said two valves.

12. An installation according to claim 9, wherein the injecting device comprises a tubular frame having an annular shape in plan extending horizontally across the hopper, the frame including evenly spaced orifices therein, said orifices having a size and being in a number determined by the desired rate of flow of the refrigerating fluid.

13. An installation according to claim 12, wherein said tubular frame has a polygonal shape in plan.

14. An installation according to claim 12 wherein the tubular frame has a circular shape in plan.

15. An installation according to claim 12, wherein said orifices are slots.

16. An installation according to claim 12, wherein said orifices are located in a lower part of an inner wall of the tubular frame and are oriented so that each of said orifices provides an elementary jet of refrigerating fluid which is downwardly oriented toward a zone in which the pressure of the powder is highest.

17. An installation according to claim 12, wherein the tubular frame is located at a height above the bottom of the receiving hopper which is between one half and one third of the height of the mass of powder.

18. An installation according to claim 9, comprising means for aspirating powder from a separate source of the powder to be cooled into the receiving hopper and toward the top of the mass of powder held in the receiving hopper by means of a current of air which precools the powder.

19. An installation according to claim 9, wherein said powder has a mean particle size in the range of 500 microns.

20. An installation according to claim 9, wherein said injection device is located in a fixed receiving hopper having a frustoconical shape.

21. An installation according to claim 9, wherein said injection device is located in a fixed receiving hopper having an inverted pyramidal shape.

* * * * *